United States Patent [19]

Fach et al.

[11] 4,238,891

[45] Dec. 16, 1980

[54] ARRANGEMENT FOR DRYING AND PREHEATING OF COKING COAL

[75] Inventors: Horst Fach, Essen; Joachim F. Meckel, Heiligenhaus, both of Fed. Rep. of Germany

[73] Assignees: Bergwerksverband GmbH; Didier Engineering GmbH, both of Essen, Fed. Rep. of Germany

[21] Appl. No.: 21,109

[22] Filed: Mar. 15, 1979

[30] Foreign Application Priority Data

Mar. 18, 1978 [DE] Fed. Rep. of Germany ..... 2811927

[51] Int. Cl.[3] ..... F26B 17/10

[52] U.S. Cl. ..... 34/57 R; 34/57 E; 34/229; 406/86; 406/113

[58] Field of Search ..... 406/86, 93, 113, 191; 34/10, 57 R, 57 E, 222, 229

[56] References Cited

U.S. PATENT DOCUMENTS

| | | | |
|---|---|---|---|
| 2,502,916 | 4/1950 | Bar | 34/57 E |
| 3,755,912 | 9/1973 | Hamada et al. | 34/57 R |
| 3,927,479 | 12/1975 | Stephanoff | 34/57 R |

*Primary Examiner*—Larry I. Schwartz

*Attorney, Agent, or Firm*—Michael J. Striker

[57] ABSTRACT

An arrangement for drying and preheating coking gas has a transport tube for transporting coal in a stream of a carrier gas, and a feed conduit for feeding hot gas into the transport tube. The feed conduit is movable relative to the tube so as to vary the conditions of feeding the hot gas into the transport tube. For this purpose, feed conduit may be connected with the transport tube by a ball-and-socket joint, so that it can be movable relative to the transport tube in circumferential and axial directions of the latter. The feed conduit may be composed by a plurality of conduit members located in the transport tube and one in the other, and movable relative to transport tube in the axial direction of the latter.

5 Claims, 3 Drawing Figures

ARRANGEMENT FOR DRYING AND PREHEATING OF COKING COAL

BACKGROUND OF THE INVENTION

The present invention relates to an arrangement for drying and preheating of coking coal.

Arrangements for drying and preheating of coking coal are known in the art. A known drying and preheating arrangement has a transport tube through which coal is transported by warm carrier gas. A feed conduit is connected with the transport tube so as to feed hot carrier gas into the latter. The drying and preheating arrangements of the above-mentioned general type are not satisfactory with respect to the variability of flow conditions of the warm carrier gas in the transport tube. Such conditions however, must be varied in practical applications of the arrangements.

SUMMARY OF THE INVENTION

Accordingly, it is an object of the present invention to provide an arrangement for drying and preheating of coking coal, which avoids the disadvantages of the prior art.

More particularly, it is an object of the present invention to provide an arrangement for drying and preheating of coking coal, which has a greater variability of flow conditions of warm carrier gas in a transport tube, as compared with those in the known arrangements.

In keeping with these objects, and with others which will become apparent hereinafter, one feature of the present invention resides, briefly stated, in an arrangement in which a feed conduit for feeding hot gas into a transport conduit is movable relative to the latter so that the conditions of feeding of the hot gas into the transport conduit can be varied.

When the arrangement is constructed in accordance with the present invention, so that the feed conduit is movable relative to the transport tube and the conditions of feeding of the hot gas can be varied, the conditions of flowing of the warm carrier gas through the transport tube can also be varied in a great range.

Another feature of the present invention is that the feed conduit is connected with the transport tube by a gas permeable ball-and-socket joint. Thereby, the feed conduit is pivotal relative to the transport tube in an axial direction and in a circumferential direction of the latter. The ball-and-socket joint may be constructed so that the socket is formed by a portion of a circumferential wall of the transport tube, whereas the ball is formed by an end portion of the feed conduit. The socket and the ball may be of one piece with the transport tube and the feed conduit, respectively.

Still another feature of the present invention is that the feed conduit may extend into an inner passage of the transport tube and be movable in an axial direction of the latter, the feed conduit may be composed of a plurality of conduit members located in the inner passage of the transport tube and one in the other. Such conduit members may be movable relative to each other and to the transport tube in the axial direction. The conduit members may be so located that their outlets are spaced from each other by differing distances.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1A:
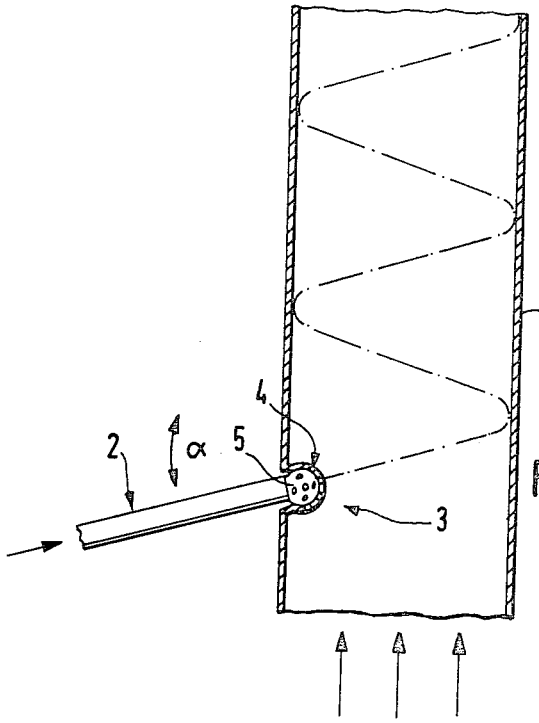
FIG. 1*a* is a schematic view showing a longitudinal section of a transport tube with a feed conduit, in accordance with the present invention.
Figure 1B:
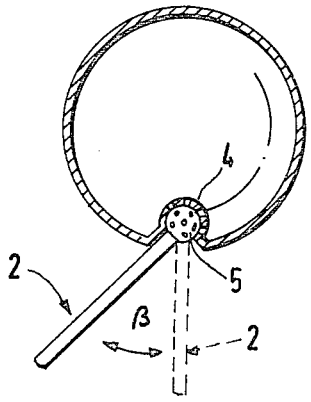
FIG. 1*b* is a schematic view showing a section of the arrangement of FIG. 1 taken in a direction transverse to an axis of the transport conduit.

An arrangement for drying and preheating of coking coal has a transport conduit which is identified by reference numeral 1. Coking coal is transported through the transport tube 1 by a warm carrier gas. As shown in FIGS. 1*a* and 1*b*, at least one feed conduit 2 is connected with the transport tube 1 so as to feed hot gas into the latter. The connection of the feed conduit 2 with the transport tube 1 is performed by a ball-and-socket joint which is gas permeable and is identified by reference numeral 3.

A gas permeable socket or shell of this joint is provided in a portion of a circumferential wall of the transport tube 1, as identified by reference numeral 4. A gas permeable ball of this joint is provided at the end of the feed conduit 2, as identified by reference numeral 5. The ball 5 of the feed conduit 2 is received in the socket 4 of the transport conduit 1. The ball 5 is of one piece with the end portion of the feed conduit 2, and the socket 4 is of one piece with the circumferential wall of the transport tube 1. However, it is understood that the above-mentioned conponents of the ball-and-socket joint 3 may be formed by separate members attachable to the transport tube 1 and the feed conduit 2, respectively.

The feed conduit 2 which is so connected with the transport tube 1 can be pivoted in an axial or vertical direction by an angle $\alpha$, as shown particularly in FIG. 1*a*. It also can be pivoted in a circumferential or horizontal direction by an angle 62, as shown particularly in FIG. 1*b*. Thereby, the direction of injecting of the hot gas from the feed conduit 2 into the transport conduit 1 can be varied so that the flow conditions in the inner passage of the transport conduit can also be varied as desired. More particularly, the injection of hot gas, performed at different locations of the circumferential wall of the transport tube 1, can be directed as desired which results in whirling of the hot gas with the coking coal to be heated.

Figure 2:
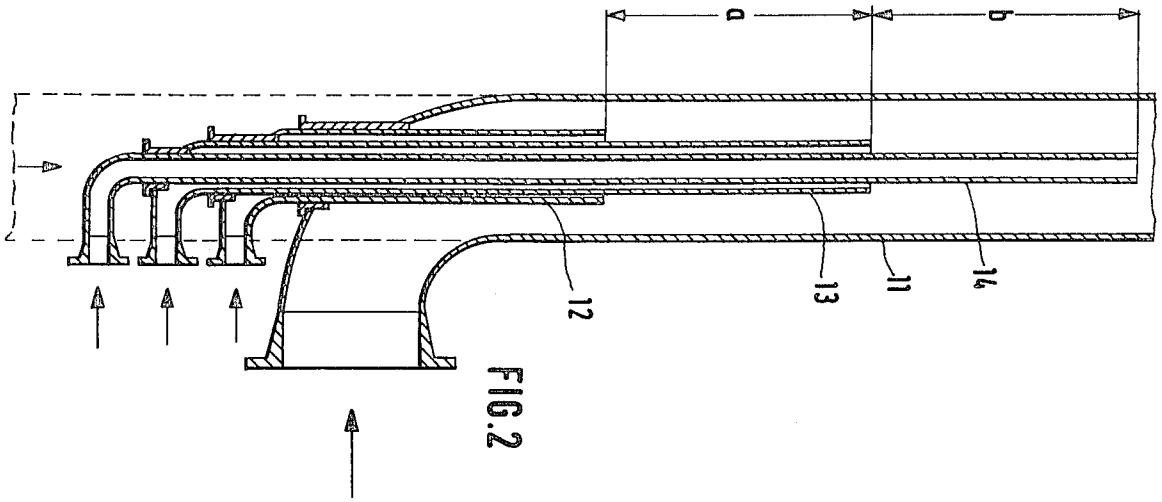
FIG. 2 is a schematic view showing a longitudinal section of the arrangement in accordance with another embodiment of the present invention.

FIG. 2 depicts an arrangement for drying and preheating coking coal, in which several feed conduits 12, 13 and 14 are located in an inner passage of a transport tube 11. The feed conduits 12, 13 and 14 are coaxial with one another and with the transport tube 11. However, this coaxiality is not always necessary. The feed conduits 12, 13 and 14 have outlets which are offset relative to one another in a direction of the axis of the transport tube 11. The outlets of the feed conduits 12 and 13 are spaced from one another by a distance a, whereas the outlets of the feed conduits 13 and 14 are spaced from one another by a distance b.

The location of the outlets of the feed conduits 12, 13 and 14 relative to one another and to the transport tube 11 may be varied both before the operation of the arrangement and during the operation. In order to make possible this variation, a wall of the arrangement is provided with slots extending substantially in the axial direction. Lower end portions of the feed conduits 12, 13 and 14, as well as a lower end portion of the transport tube 11 are curved and extend through the above-mentioned slots. Since axial dimensions of the slots exceed those of the lower portions of the feed conduits 12, 13 and 14, and of the transport conduit 11, they can be displaced axially in two opposite directions.

The above-mentioned displacement of the outlets results in that hot gas can be injected into the transport tube 11 at differing locations of the latter. Thereby, the flow conditions of the carrier gas in the inner passage of the transport conduit can be essentially varied.

The transport tube 1 has an outlet at an upper end thereof. A cyclone is located at the outlet of the transport tube 11 and operative for separating the coking coal from the carrier gas. Such a cyclone is known per se in the art, and is not shown in the drawing.

It will be understood that each of the elements described above, or two or more together, may also find a useful application in other types of constructions differing from the types described above.

While the invention has been illustrated and described as embodied in an arrangement for drying and preheating of coking coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for drying and preheating coking coal, comprising a transport tube for transporting coal in a stream of carrier gas; a feed conduit for feeding hot gas into said transport tube, said feed conduit being movable relative to said tube so as to vary the conditions of feeding said hot gas into said transport tube; and a gas permeable ball-and-socket joint which movably connects said feed conduit with said transport tube.

2. An arrangement as defined in claim 1, wherein said transport conduit has an axis and a circumferential wall, said feed conduit being connected by said joint with said circumferential wall of said transport tube so as to pivot in an axial direction and in a circumferential direction relative to the latter.

3. An arrangement as defined in claim 2, wherein said circumferential wall of said tube is provided with a gas permeable portion forming a socket of said joint, said feed conduit having an end and being provided at said end with a gas permeable portion forming a ball of said joint and received in said socket.

4. An arrangement as defined in claim 3, wherein said portion forming said socket is of one piece with said circumferential wall of said transport tube.

5. An arrangement as defined in claim 3, wherein said end portion forming said ball is of one piece with said feed conduit.

* * * * *